US007004571B2

(12) United States Patent
Garbacz et al.

(10) Patent No.: US 7,004,571 B2
(45) Date of Patent: Feb. 28, 2006

(54) PREVENTING DEFECTIVE NOZZLE INK DISCHARGE IN CONTINUOUS INKJET PRINTHEAD FROM BEING USED FOR PRINTING

(75) Inventors: Gregory J. Garbacz, Rochester, NY (US); James M. Chwalek, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 129 days.

(21) Appl. No.: 10/375,514

(22) Filed: Feb. 25, 2003

(65) Prior Publication Data

US 2004/0165038 A1 Aug. 26, 2004

(51) Int. Cl.
*B41J 2/02* (2006.01)

(52) U.S. Cl. ..... 347/73; 347/74; 347/75; 347/76; 347/77

(58) Field of Classification Search ..... 347/73–77, 347/82, 90

See application file for complete search history.

(56) References Cited

U.S. PATENT DOCUMENTS

| | | | | |
|---|---|---|---|---|
| 3,562,757 A | | 2/1971 | Bischoff | |
| 3,596,275 A | | 7/1971 | Sweet | |
| 3,709,432 A | * | 1/1973 | Robertson | 239/4 |
| 4,097,872 A | | 6/1978 | Giordano et al. | |
| 4,296,418 A | * | 10/1981 | Yamazaki et al. | 347/28 |
| 4,297,712 A | | 10/1981 | Lammers et al. | |
| 4,371,878 A | | 2/1983 | Jinnai | |
| 4,849,909 A | * | 7/1989 | Yamada et al. | 347/76 |
| 4,999,644 A | | 3/1991 | Katerberg et al. | |
| 6,003,980 A | | 12/1999 | Sheinman et al. | |
| 6,079,821 A | | 6/2000 | Chwalek et al. | |
| 6,081,281 A | | 6/2000 | Cleary et al. | |
| 6,217,163 B1 | * | 4/2001 | Anagnostopoulos et al. | 347/75 |
| 6,280,023 B1 | | 8/2001 | Ufkes | |
| 6,352,330 B1 | | 3/2002 | Lubinsky et al. | |
| 6,491,362 B1 | | 12/2002 | Jeanmaire | |
| 6,702,418 B1 | * | 3/2004 | Satou et al. | 347/19 |

FOREIGN PATENT DOCUMENTS

| | | |
|---|---|---|
| EP | 0 255 560 A | 2/1988 |
| EP | 1 219 429 A2 | 7/2002 |
| EP | 1 219 430 A | 7/2002 |
| EP | 1 243 426 A | 9/2002 |

* cited by examiner

*Primary Examiner*—Stephen D. Meier
*Assistant Examiner*—Ly T. Tran
(74) *Attorney, Agent, or Firm*—Rogers A. Fields; Mark G. Bocchetti

(57) ABSTRACT

A method, and apparatus for performing the method, are intended to prevent all of the ink discharged from a defective one of multiple nozzles in a continuous inkjet printhead from being used for printing on a print medium. This can be done by periodically heating the defective nozzle at a frequency that is greater than frequencies other nozzles which are not defective are periodically heated, to cause the defective nozzle to only discharge ink droplets that have a smaller volume than ink droplets discharged from the nozzles that are not defective. Then, the smaller volume droplets discharged from the defective nozzle are prevented from reaching a print medium, but the larger volume ink droplets discharged from the nozzles that are not defective are allowed to reach the print medium.

18 Claims, 4 Drawing Sheets

PREVENTING DEFECTIVE NOZZLE INK DISCHARGE IN CONTINUOUS INKJET PRINTHEAD FROM BEING USED FOR PRINTING

CROSS-REFERENCE TO RELATED APPLICATION

Reference is made to commonly assigned co-pending application Ser. No. 09/751,232, entitled CONTINUOUS INKJET PRINTING METHOD AND APPARATUS and filed Dec. 28, 2000 in the names of David L. Jeanmaire and James M. Chwalek.

The cross-referenced application published Dec. 14, 2001 as European Patent Application No. EP 1219429A2 and is incorporated in this patent application.

FIELD OF THE INVENTION

The invention relates generally to continuous inkjet printing, and in particular to preventing a defective nozzle ink discharge in a continuous inkjet printhead from being used for printing.

BACKGROUND OF THE INVENTION

Typically in continuous inkjet printers, a pressurized ink is formed into continuous inkjet filaments projecting from multiple ink discharge nozzles in a printhead. Filament stimulation sources such as ink heaters or transducers operate as ink droplet generators each time they are activated, by causing filament end-lengths to be broken off at the respective nozzles to provide discrete ink droplets which, in turn, are deposited on a print medium moving relative to the printhead. The interval between successive droplet break-offs at any one nozzle matches the interval between successive activations of the filament stimulation source for that nozzle. The longer the interval between successive activations of the filament stimulation source for the nozzle, the longer the opportunity for the continuous inkjet filament to increase lengthwise at the nozzle and the larger the ink droplet. Conversely, the shorter the interval between successive activations of the filament stimulation source for the nozzle, the shorter the opportunity for the continuous inkjet filament to increase lengthwise at the nozzle and the smaller the ink droplet. Thus, the volume of the ink droplet, when a droplet break-off occurs at the nozzle, corresponds to the frequency of activation of the filament stimulation source for the nozzle.

Successive ink droplets can be altered between printing and non-printing trajectories or paths. Those ink droplets that are in a printing trajectory are allowed to reach the print medium. Those ink droplets that are in a non-printing trajectory can be collected in a ink gutter or catcher and then recycled.

A problem that exists is that dirt or dried ink can accumulate on a nozzle, particularly in the region where the continuous inkjet filament projects from the nozzle. When this occurs, the nozzle must be considered defective because the ink droplets that result from filament end-lengths being broken off at the nozzle may be misdirected with respect to the printing trajectory that the ink droplets should take. Consequently, the printed image may be of a lesser quality.

The problem of misdirected ink droplets is particularly acute in continuous inkjet printers because ink flow to form a continuous inkjet filament at a nozzle that is defective cannot be stopped.

SUMMARY OF THE INVENTION

According to one aspect of the invention, there is provided a method of preventing all of the ink discharged from a defective one of multiple nozzles in a continuous inkjet printhead from being used for printing on a print medium. Generally speaking, the method comprises:

diverting all of the ink discharged from a defective nozzle from reaching a print medium, and allowing at least some of the ink discharged from other nozzles which are not defective to reach the print medium.

More specifically, the method comprises:

causing the defective nozzle to discharge only non-printing ink droplets, and allowing other nozzles which are not defective to discharge printing ink droplets which are volume-differentiated from non-printing droplets; and preventing non-printing droplets discharged from the defective nozzle from reaching a print medium, and allowing printing ink droplets discharged from the nozzles that are not defective to reach the print medium.

Further specifically, the method comprises:

periodically heating the defective nozzle at a frequency that is greater than frequencies other nozzles which are not defective are periodically heated, to cause the defective nozzle to only discharge ink droplets that have a smaller volume than ink droplets discharged from the nozzles that are not defective; and preventing smaller volume droplets discharged from the defective nozzle from reaching a print medium, and allowing larger volume ink droplets discharged from the nozzles that are not defective to reach the print medium.

According to another aspect of the invention, there is provided apparatus for performing the foregoing method.

DETAILED DESCRIPTION OF THE INVENTION

The invention is intended to be embodied in a continuous inkjet printer. Because the features of such a printer are generally known, the description which follows is directed in particular only to those elements forming part of or cooperating with the disclosed embodiment of the invention. It is to be understood, however, that other elements not disclosed may take various forms known to a person of ordinary skill in the art.

Figure 1:
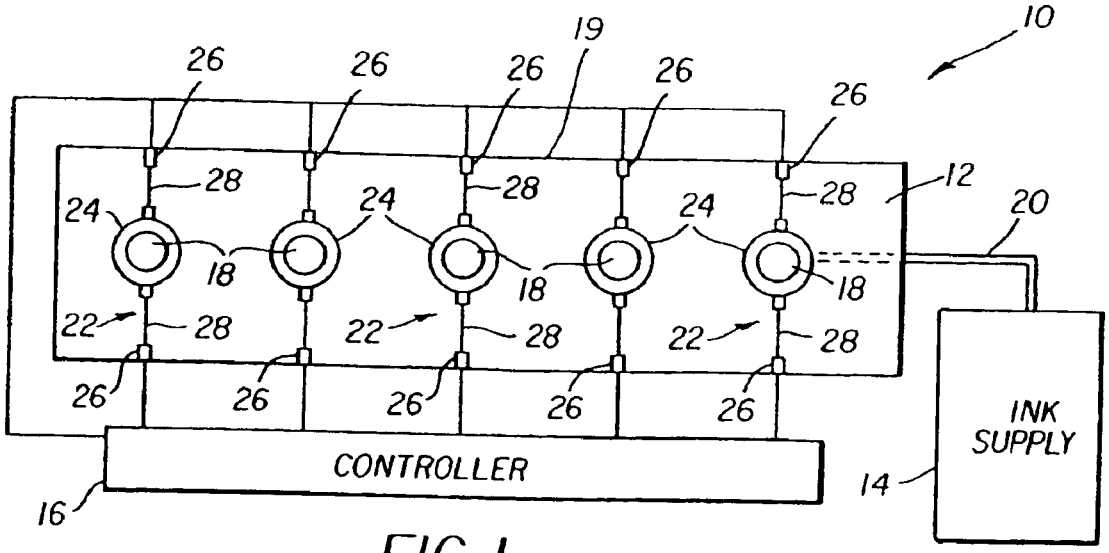
FIG. 1 depicts in schematic block form an ink droplet forming assemblage to be included in a continuous inkjet printer.

FIG. 1 shows an ink droplet forming assemblage 10 that is to be included in a continuous inkjet printer such as the one disclosed in prior art U.S. Pat. No. 6,079,821 issued Jun. 27, 2000. The '821 patent is incorporated in this patent application.

Coincident with a description of the ink droplet forming mechanism 10 which follows, there is provided a method of preventing all of the ink discharged from a defective one of multiple nozzles in the mechanism from being used for printing on a print medium.

The ink droplet forming assemblage 10 shown in FIG. 1 generally comprises a printhead 12, at least one ink supply 14 and a controller 16. It is depicted in a schematic block form, which is not to scale for the sake of clarity. The controller 16 may, for example, be a known type logic control device or a suitably programmed microprocessor as in the incorporated '821 patent.

Multiple ink discharge nozzles or outlets 18 (only five shown in FIG. 1) are provided in a nozzle plate 19 on the printhead 12. Each one of the nozzles 18 is in continuous pressurized ink-receiving communication with the ink supply 14 via an ink passage 20, for example to provide black and white or single-color printing. Alternatively, the nozzles 18 may be in continuous pressurized ink-receiving communication with multiple continuous ink supplies, for example to provide multi-color printing using three or more ink colors such as yellow, cyan and magenta. A known pump, not shown, can serve as a continuous ink-pressurizing means.

Respective known ink droplet generators, i.e. filament stimulation sources, which preferably are ink heaters 22, are positioned on the printhead 12 around the ink discharge nozzles 18 as shown in FIG. 1. Each one of the ink heaters 22 is formed in a circular or ring shape and has a similar shape resistive heating element 24 electrically connected to a conductive contact pad 26 via a conductor 28. See FIGS. 1 and 2. The conductors 28 and contact pads 26 in FIG. 1 are at least partially formed or positioned on the printhead 12, and they provide an electrical connection between the controller 16 and the ink heaters 22.

Figure 2:
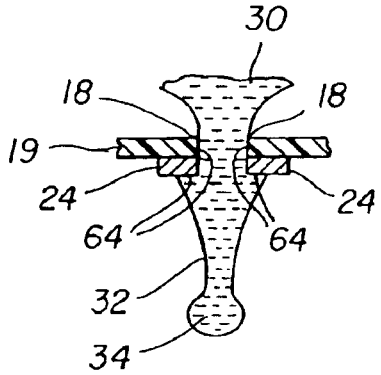
FIG. 2 is depicts in cross-section an ink discharge nozzle, an ink heater, and a continuous ink filament projecting from the nozzle.

Typically, as shown in FIG. 2, a pressurized ink 30 is formed into continuous inkjet filaments 32 (only one shown in FIG. 2) projecting from the ink discharge nozzles 18. Each time the ink heaters 22 are activated they operate (when heat-producing) as ink droplet generators, by causing respective filament end-lengths 34 to be broken off from the continuous inkjet filaments 32 at the nozzles 18 to provide discrete ink droplets (not shown in FIG. 2). The interval between successive droplet break-offs at any one nozzle 18 matches (corresponds to) the interval between successive activations of the ink heater 22 for that nozzle. The longer the interval between successive activations of the ink heater 22 for the nozzle 18, the longer the opportunity for the continuous inkjet filament 32 to increase lengthwise at the nozzle and the larger the ink droplet. Conversely, the shorter the interval between successive activations of the ink heater for the nozzle, the shorter the opportunity for the continuous inkjet filament to increase lengthwise at the nozzle and the smaller the ink droplet. Thus, the volume of the ink droplet, when a droplet break-off occurs at the nozzle, corresponds to the frequency of activation of the ink heater for the nozzle.

Figure 3A:
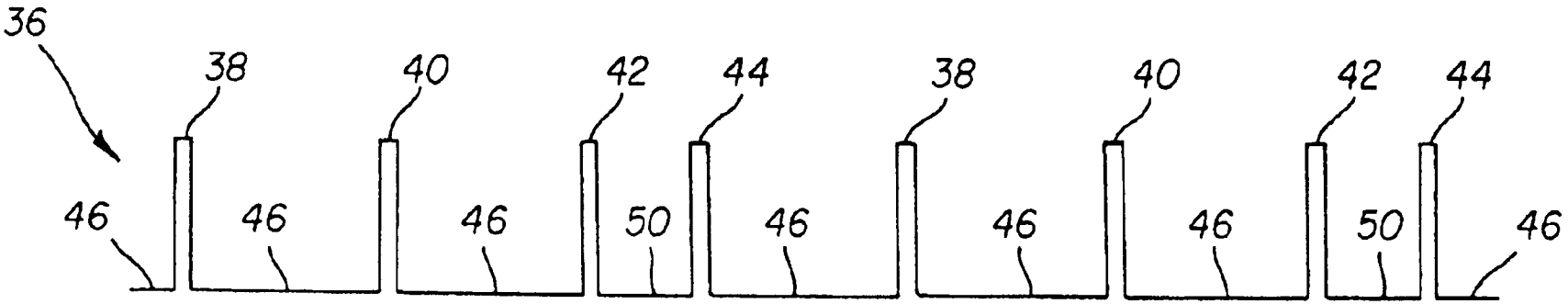
FIGS. 3A depicts a multi-burst heater-activating pulse waveform for activating ink heaters at non-defective nozzles.
Figure 3B:
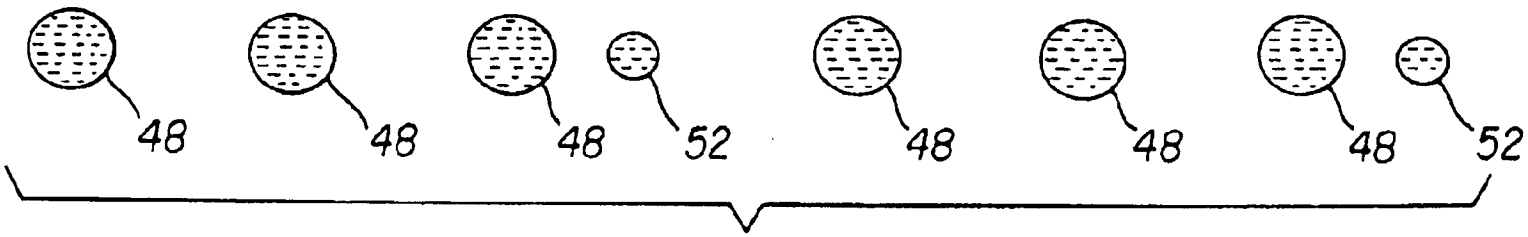
FIG. 3B depicts ink droplets resulting from the pulse waveform in FIG. 3A.

FIG. 3A shows an example of a multi-burst heater-activating pulse waveform 36 that can be provided by the controller 16 to one of the ink heaters 18 to activate the ink heater successive times to generate successive ink droplets. The pulse waveform 36 depicts a repeating series of heater-activating pulses 38, 40, 42 and 44. Each sequence of the four pulses 38, 40, 42 and 44 constitutes a single pulse burst. The intervals or delays 46 between the pulses 38 and 40, 40 and 42, and 44 and 38 are the same. Consequently, the ink droplets 48 resulting from the respective pulses 38, 40 and 42 have the same volume. See FIG. 3B. The interval or delay 50 between the pulses 42 and 44 is shorter than the intervals 46 between the pulses 38 and 40, 40 and 42, and 44 and 38. Consequently, the ink droplets 52 resulting from the pulses 44 have a similar volume that is less than the volume of the ink droplets 48.

The ink droplets 46 that have the larger volume are intended to be used as printing ink droplets. Conversely, the ink droplets 52 that have the smaller volume are non-printing ink droplets.

Figure 5:
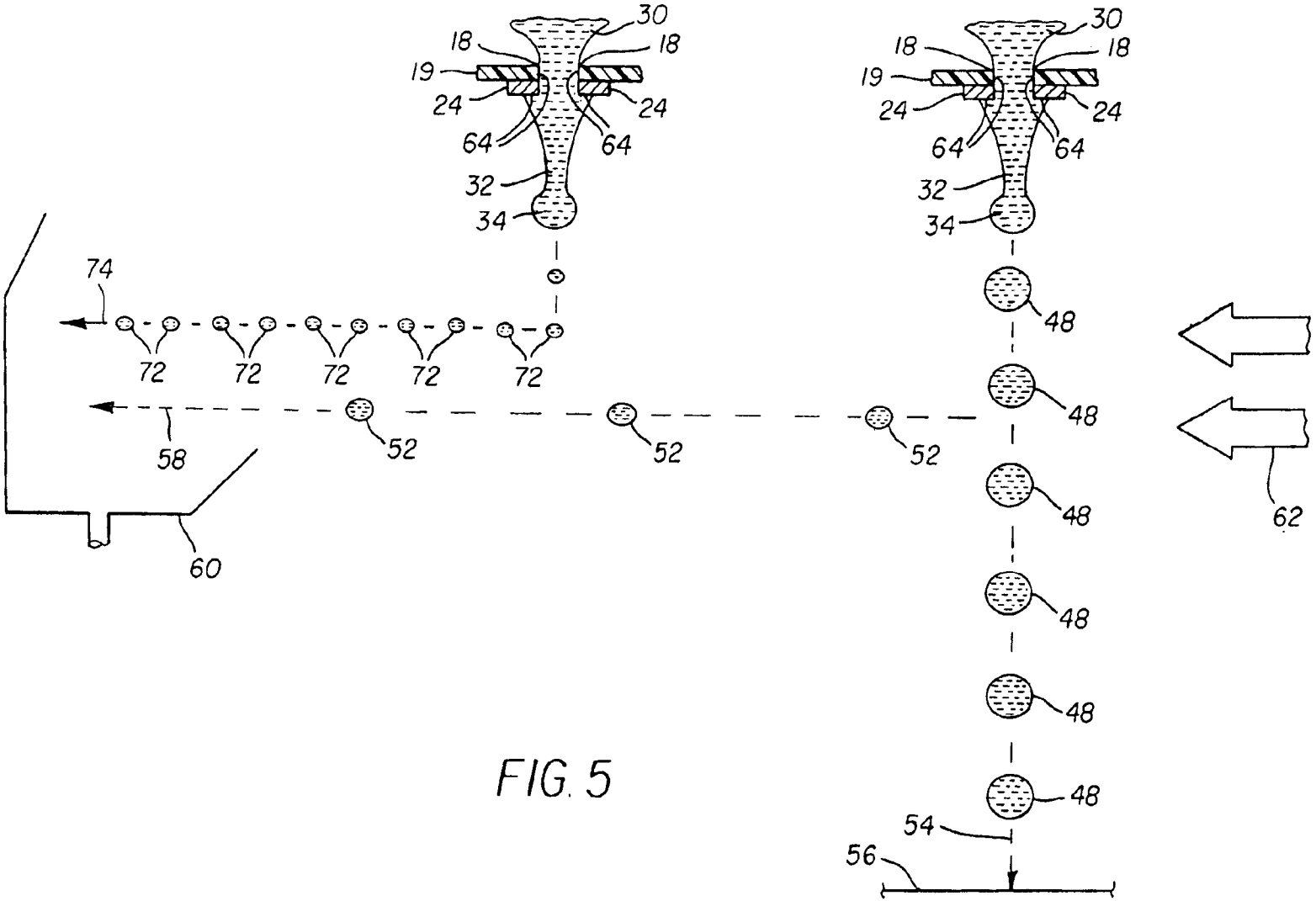
FIG. 5 shows an air blower mechanism for separating ink droplets into printing and non-printing trajectories or paths.

As shown in FIG. 5, the printing or larger volume ink droplets 46 are intended to take a printing trajectory or path 54 from the nozzles 18 to a print medium 56 such as a paper sheet which may be supported on a known rotating drum (not shown). Conversely, the non-printing or smaller volume ink droplets 52 are intended to take a non-printing trajectory or path 58 from the nozzles 18 to an ink gutter or catcher 60, in order to prevent the non-printing or smaller volume ink droplets 52 from reaching the print medium 56. Then, the non-printing or smaller volume ink droplets 52 are recycled back to the ink supply 14 via an appropriate conduit (not shown). A known air blower 62 blows air at a sufficient velocity to divert or deflect the non-printing or smaller volume ink droplets 52 into their non-printing trajectory 58 to the ink catcher 60. The air velocity is insufficient to remove the printing or larger volume ink droplets 46 from the printing trajectory 54.

A problem that exists is that dirt or dried ink can accumulate on at least one of the nozzles 18, particularly in the region where the continuous inkjet filament 32 projects from the nozzle, and also possibly in the vicinity of the heating elements 24. When this occurs, the nozzle 18 must be considered defective because the ink droplets that result from the filament end-lengths 34 being broken off at the nozzle may be misdirected with respect to the printing trajectory 54 that the ink droplets should take. Consequently, the printed image may be of a lesser quality.

Figure 4A:
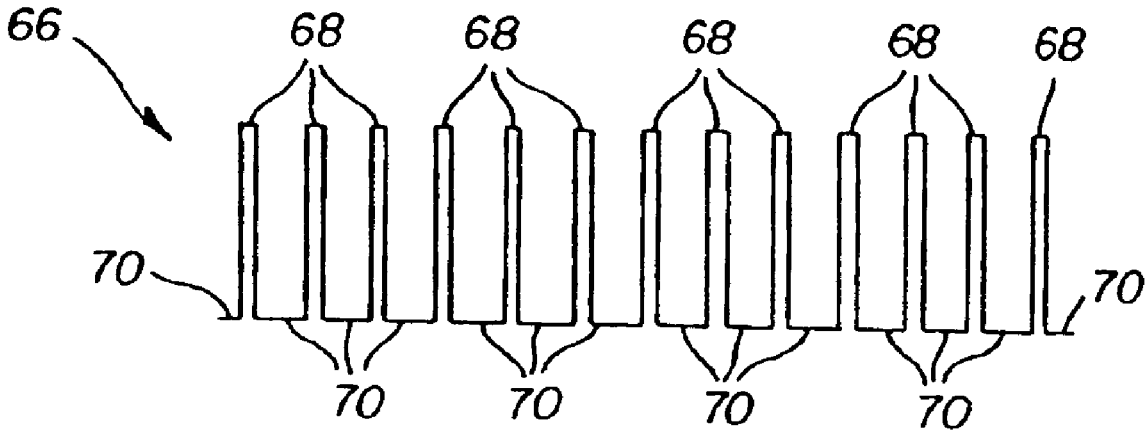
FIG. 4A depicts a multi-burst heater-activating pulse waveform for activating ink heaters at a nozzle.
Figure 4B:
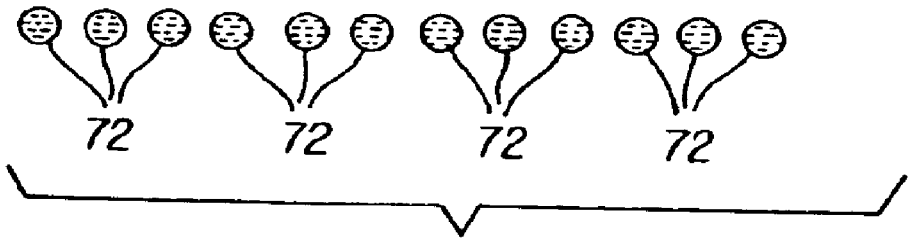
FIG. 4B depicts ink droplets resulting from the pulse waveform in FIG. 4A.

The solution to the problem is as follows. As shown in FIGS. 1 and 2, respective annular detectors 64 line the nozzles 18, particularly in the region where the continuous inkjet filaments 32 project from the nozzles, and also in the vicinity of the heating elements 24, to detect any accumulation of dirt or dried ink at each nozzle, in order to determine whether a nozzle is defective. Alternatively, the detectors 64 can be positioned to detect any ink droplets that are misdirected with respect to the printing trajectory 54 because of the accumulation of dirt or dried ink, in order to determine whether a nozzle is defective. The detectors 64 are connected to the controller 16 to enable the controller to provide a multi-burst heater-activating pulse waveform 66 to the ink heater 22 of a defective one of the nozzles 18 to activate the ink heater successive times to generate successive ink droplets as shown in FIGS. 4A and 4B. The pulse waveform 66 in FIG. 4A depicts a repeating series of heater-activating pulses 68. A twelve-pulse sequence constitutes a single pulse burst. The intervals or delays 70 between the pulses 68 for the defective nozzle are the same, and they are shorter than the intervals 46 between the pulses 38 and 40, 40 and 42, and 44 and 38 and the interval 50 between the pulses 42 and 44 for the non-defective nozzles. Consequently, in FIG. 4B, the ink droplets 72 resulting from the pulses 68 have the smallest volume, i.e. they have a smaller volume than the ink droplets 48 resulting from the respective pulses 38, 40 and 42 (which in turn have a smaller volume than the ink droplets 52 resulting from the pulses 44). Compare FIGS. 3A and 3B with FIGS. 4A and 4B.

Like the non-printing ink droplets 52 from a non-defective one of the nozzles 18, the smallest volume ink droplets 72 from a defective nozzle are non-printing ink droplets. Of course, this methodology can be reversed or modified. That is to say, the non-printing ink droplets 52 and 68 might have different volumes that are each larger than the volume of the printing ink droplets 48. Alternatively, the non-printing ink droplets 52 and 68 might have the same volume (but different than the volume of the printing ink droplets 48).

As shown in FIG. 5, the non-printing or smallest volume ink droplets 72 from a defective one of the nozzles 18 are intended to take a non-printing trajectory 74 to the ink gutter or catcher 60, in order to prevent the non-printing or smallest volume ink droplets from reaching the print medium 56. Then, the non-printing or smallest volume ink droplets 72 are recycled back to the ink supply 14 via the appropriate conduit (not shown). The non-printing trajectory 74 of the non-printing ink droplets 72 from a defective nozzle is substantially parallel to (and in the same direction as) the non-printing trajectory 58 of the non-printing ink droplets 52 from a non-defective nozzle. A known air blower 76, similar to the air blower 62, blows air at a higher velocity than the velocity of air blown by the latter blower to divert or deflect the non-printing or smallest volume ink droplets 72 into their non-printing trajectory 74 to the ink catcher 60. The higher air velocity is insufficient to remove the printing or larger volume ink droplets 46 from the printing trajectory 54.

Instead of one or both of the air blowers 76 and 62 which divert the non-printing ink droplets 72 and 52 from defective and non-defective nozzles 18 to the non-printing trajectories 74 and 58, a vacuum source can be used to attract the non-printing ink droplets 72 and/or 52 to the respective trajectories. Moreover, instead of the non-printing trajectory 74 being in the same direction as the non-printing trajectory 58, the two non-printing trajectories can be in opposite directions—in which case a second ink gutter, in addition to the ink gutter 60, would be used.

If the non-printing ink droplets 52 and 68 had the same volume (but different than the volume of the printing ink droplets 48), only a single air blower or vacuum source wold be sufficient since the non-printing ink droplets could be diverted to the same non-printing trajectory.

The invention has been described in detail with particular reference to certain preferred embodiments thereof, but it will be understood that variations and modifications can be effected within the spirit and scope of the invention.

PARTS LIST

10. ink droplet forming assemblage
12. printhead
14. ink supply
16. controller
18. ink discharge nozzle
19. nozzle plate
20. ink passage
22. ink heater
24. heating element
26. contact pad
28. conductor
30. pressurized ink
32. continuous inkjet filament
34. filament end-length
36. pulse waveform
36. heater-activating pulse
40. heater-activating pulse
42. heater-activating pulse
44. heater-activating pulse
46. pulse interval
48. larger volume printing ink droplet
50. pulse interval
52. smaller volume non-printing ink droplet
54. printing trajectory or path
56. print medium
58. non-printing trajectory or path
60. ink gutter or catcher
62. air blower
64. defective nozzle detector
66. pulse waveform
68. heater-activating pulse
70. pulse interval
72. smallest volume non-printing ink droplet
74. non-printing trajectory or path
76. air blower

What is claimed is:

1. A method of preventing all of the ink discharged from a defective one of multiple nozzles in a continuous inkjet printhead from being used for printing on a print medium, said method comprising:

operating a defective nozzle at a frequency that is greater than a operating frequency of other nozzles which are not defective, to cause the defective nozzle to only discharge ink droplets that have a smaller volume than ink droplets discharged from nozzles that are not defective;

redirecting with an air flow the smaller volume ink droplets discharged from the defective nozzle thereby preventing the smaller volume ink droplets from reaching a print medium; and allowing at least some of the ink discharged from other nozzles which are not defective to reach the print medium.

2. A method as recited in claim 1, further comprising:

collecting all of the ink discharged from the defective nozzle to be recycled for later discharge from the nozzles that are not defective.

3. A method as recited in claim 2, wherein some of the ink discharged from the nozzles that are not defective is diverted from reaching the print medium and is collected with all of the ink discharged from the defective nozzle to be recycled.

4. A method as recited in claim 3, wherein the smaller volume droplets from the defective nozzle may have the same or less volume than the smaller volume droplets from the nozzles that are not defective.

5. A method as recited in claim 3, wherein the smaller volume droplets from the defective nozzle have less volume than the smaller volume droplets from the nozzles that are not defective.

6. A method of preventing all of the ink discharged from a defective one of multiple nozzles in a continuous inkjet printhead from being used for printing on a print medium, said method comprising:

diverting all of the ink discharged from a defective nozzle from reaching a print medium, and allowing at least some of the ink discharged from other nozzles which are not defective to reach the print medium, wherein a filament stimulation source for a continuous ink filament at the defective nozzle is activated at a frequency that is higher than for filament stimulation sources for continuous ink filaments at the nozzles that are not defective, to break off discrete ink droplets from the continuous ink filament at the defective nozzle at a rate faster rate than for breaking off discrete ink droplets from the continuous ink filaments at the nozzles that are not defective, in order that the ink droplets from the continuous ink filament at the defective nozzle have a smaller volume than the ink droplets from the continuous ink filaments at the nozzles that are not defective.

7. A method of preventing all of the ink discharged from a defective one of multiple nozzles in a continuous inkjet printhead from being used for printing on a print medium, said method comprising:

causing the defective nozzle to discharge only non-printing ink droplets of a reduced size, and allowing other nozzles which are not defective to discharge printing ink droplets; and preventing non-printing droplets discharged from the defective nozzle from reaching a print medium by redirecting such non-printing droplets discharged from the defective nozzle with an air flow; and allowing printing ink droplets discharged from the nozzles that are not defective to reach the print medium.

8. A method as recited in claim 7, wherein the nozzles that are not defective are allowed to discharge non-printing ink droplets in addition to discharging printing ink droplets, and non-printing droplets discharged from the nozzles that are not defective are prevented from reaching the print medium.

9. A method of preventing all of the ink discharged from a defective one of multiple nozzles in a continuous inkjet printhead, from being used for printing on a print medium, said method comprising:

periodically heating the defective nozzle at a frequency that is greater than frequencies other nozzles which are not defective are periodically heated, to cause the defective nozzle to only discharge ink droplets that have a smaller volume than ink droplets discharged from the nozzles that are not defective; and redirecting the smaller volume droplets discharged from the defective nozzle with an air flow to prevent the smaller volume droplets from reaching a print medium, and allowing larger volume ink droplets discharged from the nozzles that are not defective to reach the print medium.

10. Apparatus for preventing all of the ink discharged from a defective one of multiple nozzles in a continuous inkjet printhead from being used for printing on a print medium, said apparatus comprising:

means for diverting all of the ink discharged from a defective nozzle from reaching a print medium; and means for causing at least some of the ink discharged from other nozzles which are not defective to reach the print medium wherein said causing means includes respective attractable filament stimulation sources for continuous ink filaments at nozzles that are not defective, which are activated at a particular frequency to break off discrete ink droplets from the ink filaments at a corresponding rate, and said diverting means includes an attractable filament stimulation source for a continuous ink filament at a defective nozzle, which is activated at a frequency that is higher than for said filament stimulation sources for continuous ink filaments at nozzles that are not defective, to break off discrete ink droplets from a continuous ink filament at a defective nozzle at a rate faster than for breaking off discrete ink droplets from continuous ink filaments at nozzles that are not defective, in order that ink droplets from a continuous ink filament at a defective nozzle have a smaller volume than ink droplets from continuous ink filaments at nozzles that are not defective.

11. Apparatus for preventing all of the ink discharged from a defective one of multiple nozzles in a continuous inkjet printhead, from being used for printing on a print medium, said apparatus comprising:

means for periodically heating a defective nozzle at a frequency that is greater than frequencies other nozzles which are not defective are periodically heated, to cause a defective nozzle to only discharge ink droplets that have a smaller volume than ink droplets discharged from nozzles that are not defective; and means for preventing smaller volume droplets discharged from a defective nozzle from reaching a print medium, and allowing larger volume ink droplets discharged from nozzles that are not defective to reach the print medium.

12. Apparatus for preventing all of the ink discharged from a defective one of multiple nozzles in a continuous inkjet printhead, from being used for printing on a print medium, said apparatus comprising:

an ink droplet generator that stimulates an ink filament projecting from a defective nozzle, the ink droplet generator operating at a frequency that causes a defective nozzle to only discharge ink droplets that have a smaller volume than ink droplets that can be discharged from nozzles that are not defective.

13. Apparatus as recited in claim 12, further comprising:

an ink droplet diverter that prevents smaller volume droplets discharged from a defective nozzle from reaching a print medium, but allows larger volume ink droplets discharged from nozzles that are not defective to reach the print medium.

14. A method of preventing all of the ink discharged from a defective one of multiple nozzles in a continuous inkjet printhead from being used for printing on a print medium, said method comprising:

operating an ink droplet generator that stimulates an ink filament projecting from a defective nozzle at a frequency that causes the defective nozzle to only discharge ink droplets that have a smaller volume than ink droplets that can be discharged from nozzles that are not defective.

15. A method as recited in claim 14 further comprising the step of:

redirecting with an air flow the smaller volume ink droplets discharged from the defective nozzle thereby preventing the smaller volume ink droplets from reaching a print medium.

16. A method as recited in claim 15 further comprising the step of:

collecting all of the ink discharged from the defective nozzle to be recycled for later discharge from the nozzles that are not defective.

17. A method as recited in claim 14 wherein:

some of the ink discharged from the nozzles that are not defective is diverted from reaching the print medium and is collected with all of the ink discharged from the defective nozzle to be recycled.

18. A method as recited in claim 14 further comprising the step of:

collecting all of the ink discharged from the defective nozzle to be recycled for later discharge from the nozzles that are not defective.

* * * * *

UNITED STATES PATENT AND TRADEMARK OFFICE

CERTIFICATE OF CORRECTION

PATENT NO. : 7,004,571 B2
APPLICATION NO. : 10/375514
DATED : February 28, 2006
INVENTOR(S) : Gregory J. Garbacz et al.

It is certified that error appears in the above-identified patent and that said Letters Patent is hereby corrected as shown below:

| | |
|---|---|
| Column 7, Line 54 | Please replace the text "respective attractable" with the following corrected text --respective activatable-- |
| Column 7, Line 59 | Please replace the text "an attractable" with the following corrected text --an activatable-- |

Signed and Sealed this

Tenth Day of October, 2006

JON W. DUDAS
*Director of the United States Patent and Trademark Office*